United States Patent [19]

Beck

[11] Patent Number: 4,938,725

[45] Date of Patent: Jul. 3, 1990

[54] RETRACTABLE SURFBOARD LEASH

[76] Inventor: Steven Beck, #5 Copley St., Laguna Niguel, Calif. 92680

[21] Appl. No.: 379,335

[22] Filed: Jul. 13, 1989

[51] Int. Cl.[5] ..... A63C 15/06

[52] U.S. Cl. ..... 441/75; 441/74

[58] Field of Search ..... 441/74, 75; 114/230, 114/39.2; 119/96, 106, 124

[56] References Cited

U.S. PATENT DOCUMENTS

| | | | |
|---|---|---|---|
| 2,437,786 | 3/1948 | Oberdorf et al. | 119/124 |
| 3,851,613 | 12/1974 | Armour | 114/230 |
| 4,107,806 | 8/1978 | Newland et al. | 441/75 |
| 4,479,785 | 10/1984 | Tugwood et al. | 441/75 |
| 4,621,589 | 11/1986 | Thinnes | 119/124 X |

FOREIGN PATENT DOCUMENTS

| | | | |
|---|---|---|---|
| 0291293 | 12/1986 | Japan | 441/75 |

*Primary Examiner*—Joseph F. Peters, Jr.
*Assistant Examiner*—Edwin L. Swinehart
*Attorney, Agent, or Firm*—Morland C. Fischer

[57] ABSTRACT

A leash including a cord to attach a surfer to his surfboard. The cord is retractable by spring action into a housing so as to eliminate slack or excess cord length and thereby reduce both the potential for tangling and drag through the water. The housing is detachably connected to the surfboard at the existing crossbar which is typically embedded therewithin.

7 Claims, 3 Drawing Sheets

RETRACTABLE SURFBOARD LEASH

BACKGROUND OF THE INVENTION

1. Field of the Invention

This invention relates to a device which permits a surfboard to be attached to a surfer and, more particularly, to a leash including a cord which is retractable into a housing to eliminate possible tangling and reduce the drag that is created when the cord is pulled through the water.

2. Background Art

It is currently known to attach a surfboard to a surfer by means of a cord which is affixed to the surfboard at one end thereof and attached to the surfer at the other end, typically via a wrist or ankle strap. The length of the cord is usually between four to six feet in order to provide a safe distance between the surfer and his board should the board be separated from the surfer and tumbled through the surf.

The existing means of attachment does not address the difficulties caused by the relatively long cord length with regard to the potential for tangling as well as to the loss of hydrodynamic efficiency as excess cord is dragged through the water. Therefore, it would be desirable to have a surfboard attachment device which would eliminate excess cord length and thereby avoid tangling and dragging through the water, while still allowing for the cord to extend to a safe length when needed.

SUMMARY OF THE INVENTION

In general terms, a surfboard leash is disclosed including a cord by which a surfboard can be attached to a surfer. The cord is retractable into a housing under spring action in much the same way that a standard tape measure, common to the construction industry, is retracted. Accordingly, excess cord length is eliminated to reduce both the potential for tangling and drag caused when the cord is pulled through the water. The housing, into which the cord is retracted, is detachably connected to the surfboard at the existing crossbar that is typically embedded within the board. More particularly, the housing has a clip or a hook extending therefrom which is sized to surround and engage the crossbar. Means are also provided by which the hook can be removed from the housing.

DESCRIPTION OF THE PREFERRED EMBODIMENT

Figure 1:
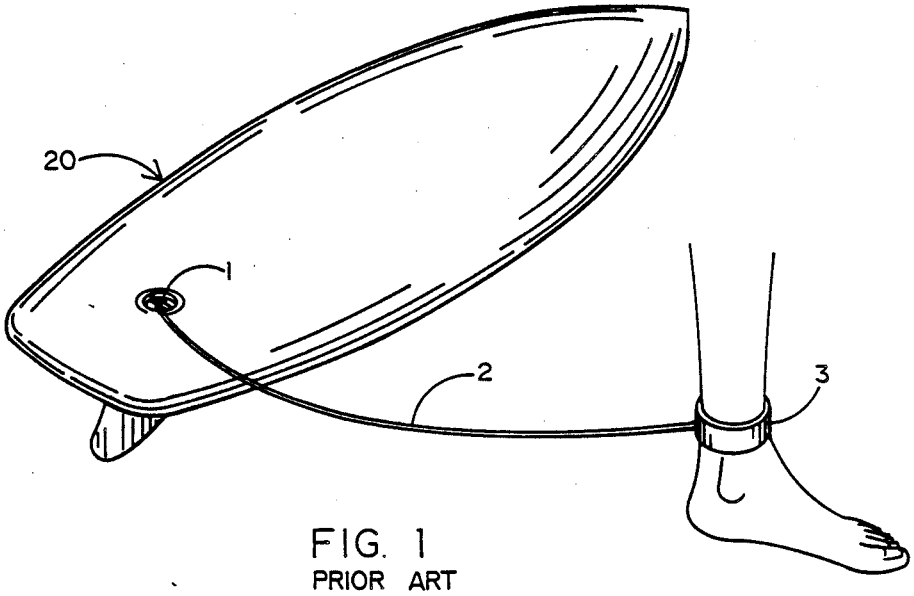
FIG. 1 PRIOR ART
FIG. 1 shows the prior art device for attaching a surfer to his surfboard.

Referring to the drawings, FIG. 1 shows a conventional device for attaching a surfer to his surfboard 20. More particularly, a cord 2 (e.g. rubber tubing) is affixed at one end thereof to the existing crossbar 1 that is typically integral to and embedded within the surfboard 20. The opposite end of cord 2 is affixed to a strap 3. The strap 3 is adapted to be releasably secured around the wrist or ankle of the surfer, such that an attachment exists between the surfer, at strap 3, and the surfboard, at crossbar 1, via cord 2. The conventional attachment device of FIG. 1 uses a cord 2 of relatively long (e.g. between four to six feet) and constant length. This long length is known to contribute to tangling and loss of hydrodynamic efficiency as excess cord is dragged through the water during use.

Figure 2:
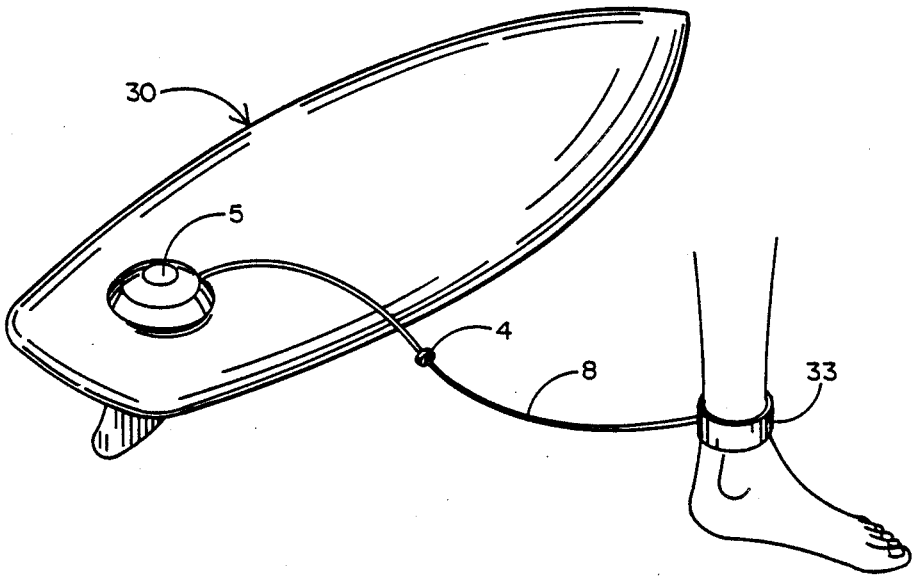
FIG. 2 is illustrative of the surfboard leash which forms the present invention including a retractable cord that is attached between the surfer and his surfboard.

FIG. 2 of the drawings illustrates the surfboard leash that forms the present invention and which eliminates the slack or excess cord length that is otherwise common to the conventional attachment device of FIG. 1. More particularly, a cord 8 is affixed at one end to the surfboard 30 and the opposite end to a strap 33 that is to be releasably attached to the surfer's wrist or ankle. As will soon be explained, the cord 8 is pulled out of and retracted into a housing 5 that is detachably connected to the surfboard 30. Therefore, the cord 8 includes a stopper 4 that is positioned at a suitable location therealong to prevent the complete retraction of the cord within the housing 5 and prevent tension on the cord between the stopper 4 and strap 33.

Figure 3:
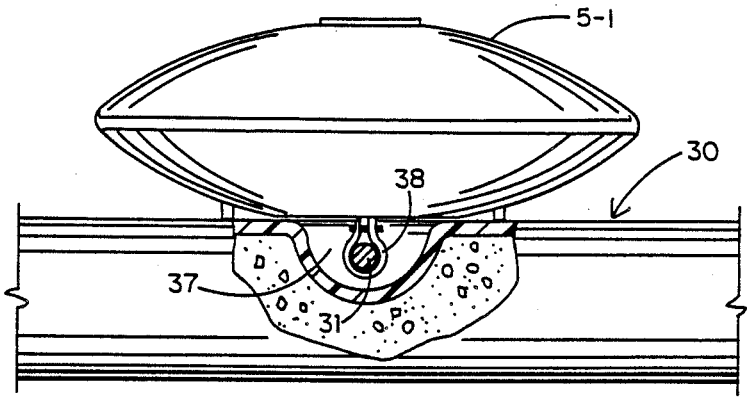
FIG. 3 shows a partial cross-section of the surfboard of FIG. 2 and one means for releasably connecting a housing, into which the cord is retracted, to said surfboard.
Figure 4:
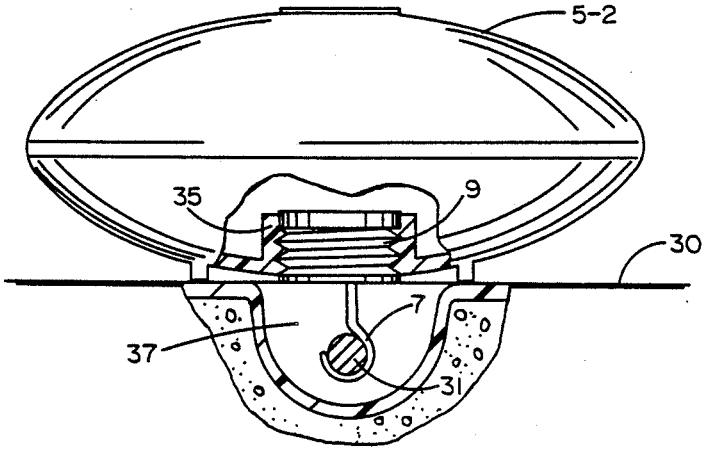
FIG. 4 shows a partial cross-section of the surfboard of FIG. 2 and another means for releasably connecting a housing, into which a cord is retracted, to said surfboard.
Figure 5:
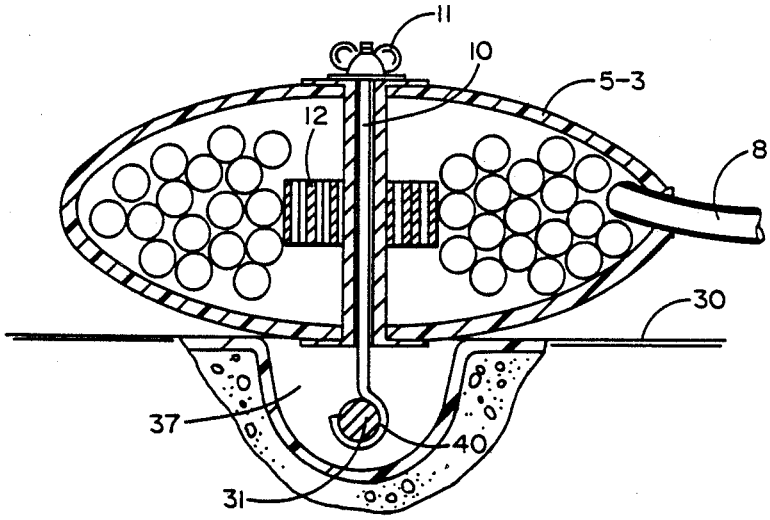
FIG. 5 shows a cross-section of a housing having a spring biased cord retracted therein and an additional means for releasably connecting the housing to the surfboard of FIG. 2.

FIGS. 3–5 of the drawings illustrate means for detachably connecting the housing, into which the cord 8 is to be retracted, to the surfboard 30 at the existing crossbar 31 thereof. Referring initially to FIG. 3, the housing 5-1 includes a clip 38 extending downwardly therefrom. The clip 38 is sized to surround and engage the crossbar 31 which is embedded within the surfboard 30.

In FIG. 4, the housing 5-2 includes a screw threaded receptacle 35. The receptacle 35 of housing 5-2 is adapted to be mated to a corresponding screw threaded insert 9. Insert 9 includes a hook 7 which is sized to surround and engage the crossbar 31 of surfboard 30 via the cavity 37 thereof. That is to say, the hook 7 is positioned around crossbar 31, and the screw threaded insert 9 is mated to (i.e. screwed into) the housing 5-2 at the screw-threaded receptacle 35 thereof. By rotating the housing 5-2 in a first direction relative to insert 9, said housing will be pulled towards and affixed to the base of surfboard 30. To detach the housing 5-2 from surfboard 30, the housing is rotated in an opposite direction relative to the insert 9 until the insert 9 has been unscrewed from said housing 5-2, whereupon said insert can be unhooked from crossbar 31.

FIG. 5 illustrates another means for detachably connecting the housing, into which the cord 8 is to be retracted, to the surfboard 30. The housing 5-3 includes a relatively narrow, vertically extending channel through which a elongated rod 10 is to be received. One end of rod 10 is screw threaded, and the opposite end includes a hook 40. The screw threaded end of rod 10 is adapted to be mated to a corresponding fastener, such as a wing nut 11, or the like. The hook 40 of rod 10 is sized to surround and engage the crossbar 31 of surfboard 30 through the cavity 37 thereof. That is to say, the elongated rod 10 is inserted through the vertical channel of housing 5-3, and the fastener 11 is mated to (i.e. screwed onto) the screw threaded end of said rod. The hook 40 of rod 10 is then positioned around the crossbar 31. By rotating the fastener 11 in a first direction relative to rod 10, the housing 5-3 will be pulled towards and affixed to the base of the surfboard 30. To detach the housing 5-3 from surfboard 30, the fastener 11 is rotated in an opposite direction relative to rod 10 so as to be removed therefrom. Accordingly, the housing 5-3 may be lifted off the rod 10 to permit the hook 40 thereof to be unhooked from crossbar 31.

As is best shown in FIG. 5, a spring 12 is located at the interior of the housing 5-3. The spring 12 is similar to that used with a retractable tape measure. The cord 8 is interfaced with spring 12 so as to be retracted, by spring action, and coiled up within the housing, whereby to eliminate slack and excess cord length. However, and as was earlier described, a stopper (designated 4 in FIG. 2) prevents the cord 8 from being completely retracted into its housing so as to facilitate the attachment of said cord to the surfer.

Figure 6:
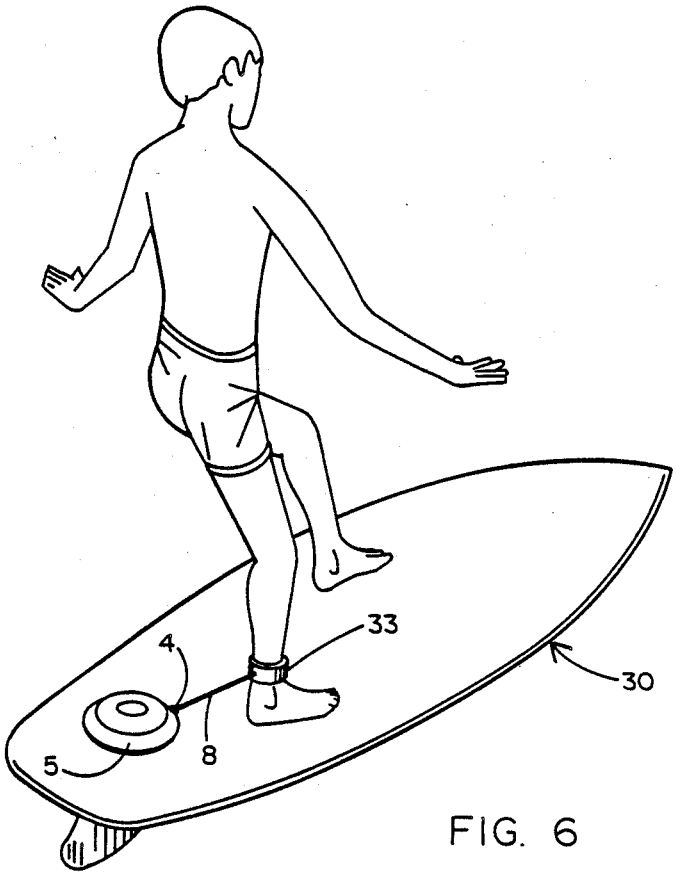
FIG. 6 shows the surfboard leash of the present invention when the surfer is riding his surfboard and the retractable cord is retracted within its housing.
Figure 7:
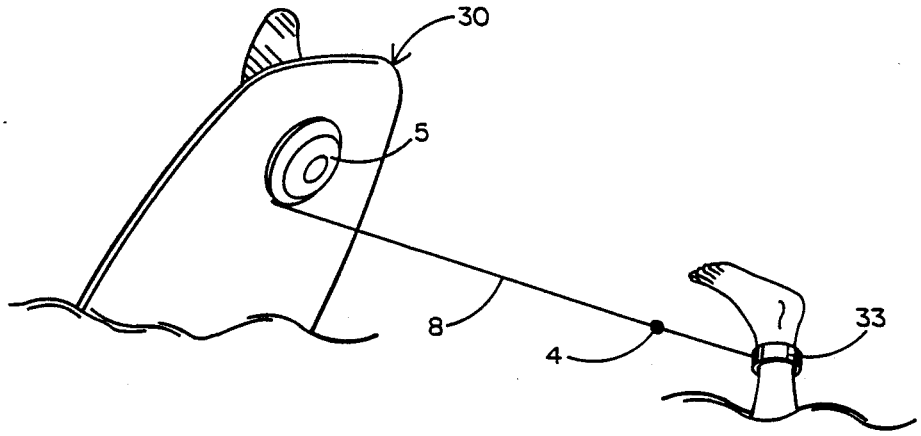
FIG. 7 shows the surfboard leash of FIG. 6 when the surfer has fallen off his surfboard and the retractable cord is pulled out of its housing.

FIGS. 6 and 7 of the drawings show the surfboard leash of the present invention in use with the retractable cord 8 thereof attached between the surfboard 30 (at housing 5) and the surfer's ankle (at strap 33). With the surfer riding the surfboard (FIG. 6), the cord 8 is retracted towards the interior of housing 5 so as to eliminate slack and thereby avoid entanglement and reduce drag through the water. However, in the event that the surfer should fall off his surfboard (FIG. 7), a force will be applied to cord 8 which is sufficient to overcome the spring bias thereof, such that the cord 8 is pulled out of its housing 5. The feeding out of cord 8 from housing 5 allows for a safe distance between the surfer and his surfboard 30 while the board is being tumbled through the surf.

What is claimed is:

1. A leash assembly for attaching a surfboard to a surfer, the surfboard including a crossbar embedded therein, at least some of the crossbar being accessible through a cavity formed in the surfboard, said leash assembly comprising:

a cord;

a housing into which at least some of said cord is to be retracted;

means to attach one end of said cord to the surfer;

means to connect the opposite end of said cord at the interior of said housing;

means to retract said cord into said housing; and means by which to detachably connect said housing to the crossbar of the surfboard via the cavity.

2. The leash assembly recited in claim 1, wherein said means to retract said cord into said housing is a spring that is connected to said cord at the interior of said housing.

3. The leash assembly recited in claim 1, wherein said means to detachably connect said housing includes a clip extending from said housing to surround and engage the crossbar via the cavity in the surfboard.

4. The leash assembly recited in claim 1, wherein said means to detachably connect said housing includes a hook extending from said housing to surround and engage the crossbar via the cavity in the surfboard.

5. The leash assembly recited in claim 4, wherein said hook is removably connected to said housing.

6. The leash assembly recited in claim 4, wherein said hook is affixed to and projects from a screw threaded insert, said housing having a screw threaded receptacle into which said insert is screwed for removably connecting said hook to said housing.

7. The leash assembly recited in claim 4, further comprising a rod interconnecting with said housing, one end of said rod having said hook formed thereat and the opposite end of said rod extending within said housing and being mated to a fastener for releasably connecting said rod to said housing.

* * * * *